US006703593B2

(12) United States Patent
Sopory

(10) Patent No.: US 6,703,593 B2
(45) Date of Patent: Mar. 9, 2004

(54) LOW AND HIGH VOLTAGE ELECTRICAL HEATING DEVICES

(75) Inventor: Umesh Sopory, Fremont, CA (US)

(73) Assignee: Asuk Technologies LLC, San Leandro, CA (US)

( * ) Notice: Subject to any disclaimer, the term of this patent is extended or adjusted under 35 U.S.C. 154(b) by 0 days.

(21) Appl. No.: 10/241,710

(22) Filed: Sep. 10, 2002

(65) Prior Publication Data

US 2003/0052121 A1 Mar. 20, 2003

(51) Int. Cl.[7] ..... H05B 1/02
(52) U.S. Cl. ..... 219/505; 219/494; 219/535
(58) Field of Search ..... 219/505, 506, 219/528, 553, 548, 538, 535, 485, 486, 494; 338/328, 22 R, 254; 340/450

(56) References Cited

U.S. PATENT DOCUMENTS 3,863,210 A * 1/1975 Roland et al. ..... 340/450
4,329,726 A * 5/1982 Middleman et al. ..... 219/505
5,451,747 A * 9/1995 Sullivan et al. ..... 219/528
6,492,629 B1 * 12/2002 Sopory ..... 219/535

* cited by examiner

*Primary Examiner*—Tu Ra Hoang
(74) *Attorney, Agent, or Firm*—Larry B. Guernsey; IPLO Intellectual Property Law Offices

(57) ABSTRACT

A low-voltage self-regulating heating device (200) for operation with supply voltages in the range of 0.1–12 volts having first and second layers (104, 106) of material, at least one of which is PTC material interposed between a first electrode (102) and a second electrode (108). Also a high-voltage self-regulating heating device (300) for operation with supply voltages above 240 volts having first and second layers (104, 106) of material, at least one of which is PTC material interposed between a first electrode (102) and a second electrode (108).

28 Claims, 6 Drawing Sheets

PTC Heaters Resistance vs. Temperature

LOW AND HIGH VOLTAGE ELECTRICAL HEATING DEVICES

This application is a continuation-in-part of application Ser. No. 09/720,057, filed Dec. 18, 2000, now U.S. Pat. No. 6,492,629 which has the same inventor as the present invention.

TECHNICAL FIELD

The present invention relates generally to heating devices and resettable fuses, and more particularly to heaters which are flexible and fuse devices which use positive temperature coefficient (PTC), negative temperature coefficient (NTC) material, and/or Voltage Sensitive Material (VSM) to provide current and voltage protection for a circuit or device.

BACKGROUND ART

There have been prior attempts to make flexible self-regulating heating elements. U.S. Pat. No. 4,668,857 to Smuckler, U.S. Pat. No. 4,503,322 to Kisimoto, U.S. Pat. No. 5,558,794 to Jansens, U.S. Pat. No. 4,742,212 to Ishi, U.S. Pat. No. 4,661,690 to Yamamoto and U.S. Pat. No. 4,200,973 to Farkas disclose various types of heaters in the form of cables. Some, such as the embodiment pictured in FIG. 1 of Smuckler have a side-by-side construction which will not be equally flexible in all directions. Additionally, the heaters which use PTC materials as a self-regulating device, generally must be designed differently to work with 120 volt line voltages than with 240 volt line voltages. There is a need for a heater cable which can be used with both such power supplies.

Self regulating heaters have also been formed into sheets in such patents as U.S. Pat. No. 4,777,351 to Batliwalla, U.S. Pat. No. 4,700,054 to Triplett, and U.S. Pat. No. 5,422,462 to Kishimoto. In these patents, the heating elements are configured as sheets, or as fabrics, which have interdigitized or interleaved electrodes between which elements of PTC are positioned. This allows the use generally of a limited range of voltages, generally 120 Volts, and thus a limited amount of heat production. There are some heaters which may operate at as much as 480 Volts, these are generally three input, three phase systems, but to the inventor's knowledge, there is no heater system which can be operated at 480 Volts with a two input bus system.

There are many applications in which it is desirable to wrap irregular objects, such as pipeline valves with heating devices. Many of these applications also require much flexibility in the amount and shape of the heater material used. For this reason, it is highly desirable that self-regulating heaters be modular in design, so that specific lengths of heater material may be joined together to make greater lengths, and also desirable that the lengths be capable of being trimmed to shorter lengths, without of course losing power or heating capacity. Of course, the most preferred example of this flexibility in length choice would be if the material is capable of being trimmed to any length within a modular section, that is, it is continuously variable. Next best is a material which contains certain defined zones for the heating elements, and the material may be trimmed in between any of these heating zones. This allows the length to be varied in multiples of these zone lengths, and these can be referred to as incrementally variable in length.

There have been several attempts at creating modular heaters which are self-regulating. U.S. Pat. No. 4,638,150 to Whitney, and U.S. Pat. No. 4,072,848 to Johnson show heaters which have self-regulating elements and which may be considered modular. These heating modules are generally rigid, and if they are trimmable at all, they would certainly be only incrementally variable. As the elements are generally not flexible, their application is thus expected to be limited.

PTC elements have also been used as resettable fuses in U.S. Pat. Nos. 5,796,569, and 5,818,676 to Gronowicsz, U.S. Pat. No. 5,682,130 to Styrna, U.S. Pat. No. 5,801,914 to Thrash, and U.S. Pat. No. 5,495,383 to Yoshioka. These fuses will protect the circuit from current which is too high, but will provide little protection for voltage spikes, for which the response time of PTC may be too slow. Thus there is a need for a resettable fuse which can protect a circuit from voltage spikes.

DISCLOSURE OF INVENTION

Accordingly, it is an object of the present invention to provide modular or long length heaters which are flexible to conform to shapes of irregular objects and can be made to wrap around pipes.

Another object of the invention is to provide modular heaters which can connectable to any length or interconnected.

And, another object of the invention is to provide low voltage heaters which operate in the range of 0.1–12 volts.

A further object of the invention is to provide high voltage heaters which operate over 240 volts.

A yet further object of the present invention is to provide heaters which are either self-limiting, or which provide built-in safety protection.

Briefly, a preferred embodiment of the present invention is a self-regulating heating device for operation with supply voltages in the range of 0.1–12 volts having first and second layers of material, at least one of which is PTC material interposed between a first electrode and a second electrode.

Another preferred embodiment is a self-regulating heating device for operation with supply voltages above 240 volts having first and second layers of material, at least one of which is PTC material interposed between a first electrode and a second electrode.

An advantage of the present self-regulating modular heater is that it is very flexible, can fit around irregular fittings and valves, can be attached together in modular lengths and can be cut to almost any desired length.

Another advantage of the present self-regulating modular heater is that they also are very flexible, can wrap around small diameter pipes, and can also be used with low voltage power supplies in the range of 0.1–12 volts AC or DC, so that they can be powered, for instance, by batteries.

A further advantage of the present self-regulating modular heater is that they can be used at high voltages above 240 volts.

These and other objects and advantages of the present invention will become clear to those skilled in the art in view of the description of the best presently known mode of carrying out the invention and the industrial applicability of the preferred embodiment as described herein and as illustrated in the several figures of the drawings.

BRIEF DESCRIPTION OF THE DRAWINGS

The purposes and advantages of the present invention will be apparent from the following detailed description in conjunction with the appended drawings in which.

BEST MODE FOR CARRYING OUT THE INVENTION

Figure 1:
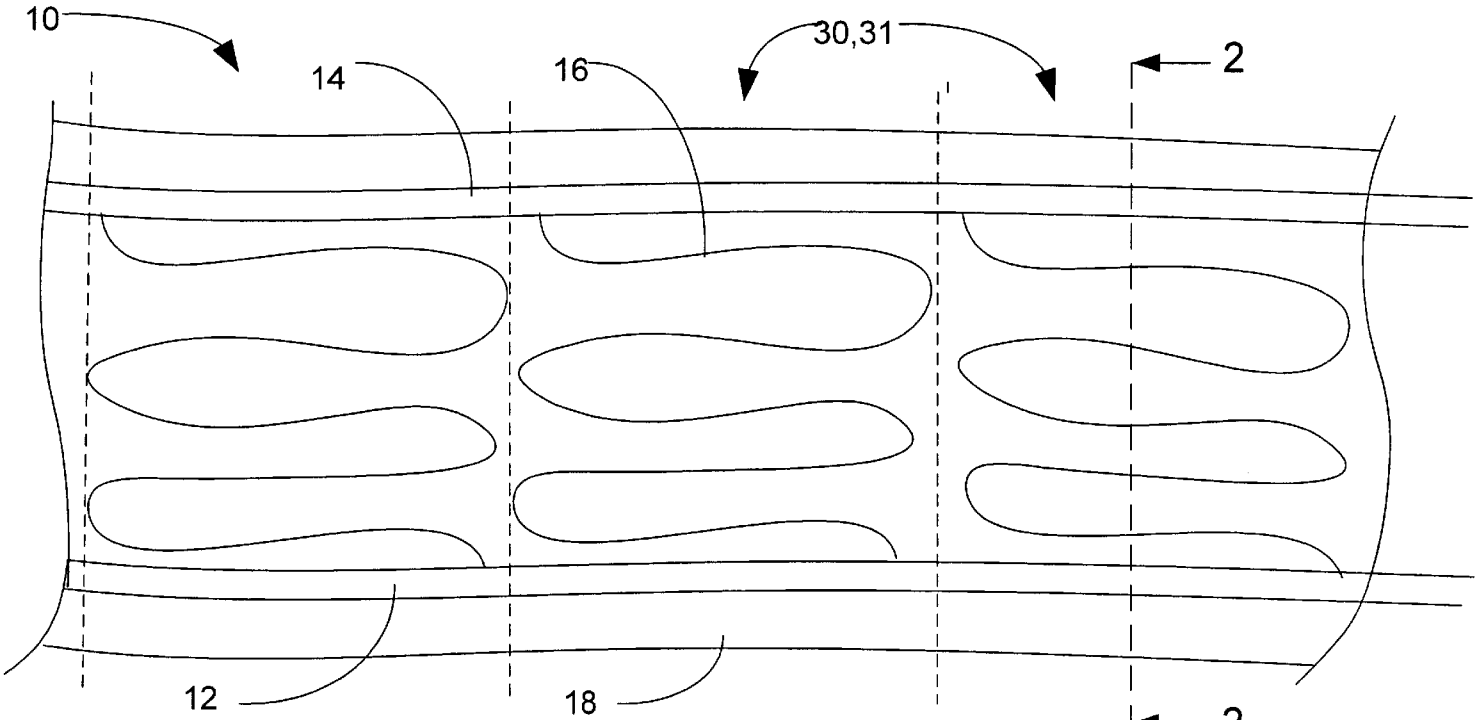
FIG. 1 illustrates a top plan view of a section of a high temperature modular or long length heater of the present invention, showing three heating zones.

A first preferred embodiment of the present invention is a high temperature modular heater. As illustrated in the various drawings herein, and particularly in the view of FIG. 1, a form of this preferred embodiment of the inventive device is depicted by the general reference character 10.

There are many applications in which materials must be maintained at high-temperature in the range of 500–600 degrees F. Such applications include maintaining asphalt and sulfur in a liquid state. If these materials can be kept in a molten state, they can be made to flow through pipes, thus easily conveying them to a site of usage. A difficulty encountered when piping these materials, however, is the heat loss experienced when the material is forced to flow through unheated pipes. Heat loss can be great from these pipes, causing the material to solidify and block material flow. A common industry technique is to provide heater strips which heat a portion of the pipe sufficiently that material flow is maintained. Attempts have been made to make heaters which may wrap around a pipe to give more uniform heating, however most heaters which are capable of reaching the appropriate temperature range are generally not very flexible. The few heaters manufactured which are flexible enough to wrap pipes generally do so by being wound in a helix or "S" pattern. This is an improvement over a rigid strip, but the heat applied is still far from uniform, and there are inevitably cold spots in which cooler material tends to accumulate and slow material flow. The problem is especially acute in the area of valves, which are generally complicated enough in shape that no attempt is made to wrap them with heater wires. Material is especially prone to freezing at these points, which not only interferes with material flow, but prevents the valves from operating correctly so that control of flow is hampered or lost.

The first embodiment of the present invention provides high temperature heaters which are very flexible, which can be manufactured in a series of modules which can be connected together to cover nearly any length of pipe, and which can also be trimmed to length and the trimmed end sealed to further accommodate any intermediate length of pipe.

FIG. 1 illustrates the major components of the modular high-temperature heater 10, but with an outer jacket removed. There are a first bus wire 12 and a second bus wire 14 with a plurality of heating wires 16 winding in a serpentine pattern to connect in parallel between the two bus wires. The bus wires 12, 14 are preferably of 14 AWG nickel-copper stranded flat bus wire and the heating wire 16 is preferably a nickel alloy such as Inconel or Nichrome which can be very narrow gage, in the 0.003–0.005 inch range, although the invention is by no means limited to these materials or dimensions. Nickel alloy has been chosen for this embodiment, because it can be heated to temperatures of up to 1200° F., and has excellent flexibility, especially at narrow gages. These wires are positioned on a substrate 18, preferably of mica and glass.

Figure 2:
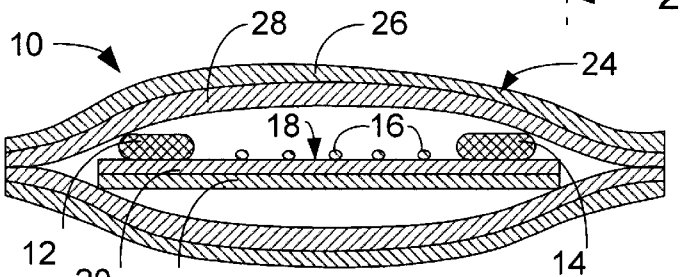
FIG. 2 shows a cross-sectional view of a heater module of the present invention taken through line 2—2 in FIG. 1; and, FIG. 3 illustrates a perspective view of the method of installation of three modular heaters of the present invention on a pipe and valve, showing a specialized valve fitting, as one of the modules.

Referring now also to FIG. 2, which is a cross-sectional view of a modular heater 10, but now also showing the outer insulating jacket 24, which had been removed from the previous view. No attempt has been made to draw the elements to scale. The heating wires 16 are sewn or positioned on a substrate 18 of mica 20 and glass 22, which is then sewn into a jacket 24 preferably also composed of layers of glass 26 and mica 28. The heating wires 16 form a number of parallel circuits with the supply buses 12, 14, which effectively divide the total length into zones 30, each zone being a module 31, three of which are shown in the figure. Since these zones are electrically parallel to each other, the modular heater 10 can be cut at any zone boundary, and the uncut length will still function. It is desirable to seal the end to prevent moisture and corrosion from entering at the cut end, and to electrically insulate the exposed end, but this is not an absolute requirement. Thus the modular heater 10 can be cut to the length of any multiple of the zone lengths. The presently preferred length of a zone is 1.5 feet, but this is of course subject to much variation, and can be easily customized for particular applications. The insulation jackets may vary, having, for instance, multiple layers of glass 26 and mica 28, depending on the application and voltage applied. These heaters may further be laminated with insulation and/or jacketed with metal, such as Inconel, steel, copper, iron or polymer to provide moisture protection. Metal outer jackets may be welded at the ends to make air-tight seals.

The modular heater 10 is preferably manufactured in standard lengths which can be joined together end to end, perhaps with standard connector fittings. The modular heaters 10 are extremely flexible and can be fabricated to wrap easily around a pipe of ½ inch diameter, while providing very uniform heat to the pipe.

Figure 3:
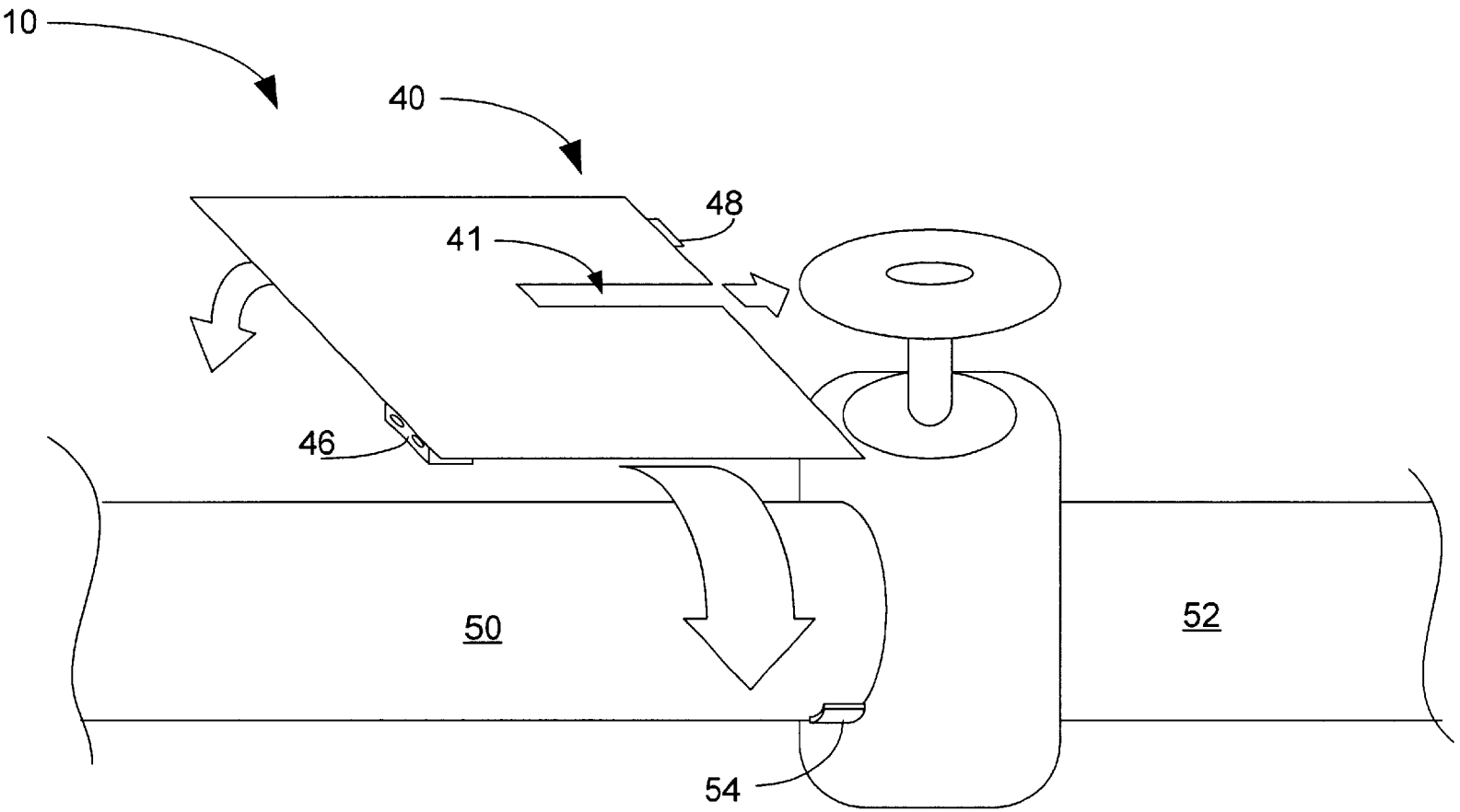

For wrapping pipe fittings such as valves, T's and flanges, special modular sections can be designed. FIG. 3 shows one such modular valve heater 40 about to be installed on a pipe valve. The valve heater 40 may be designed in a generally "U" shape, which slides on with the slot 41 of the U surrounding the valve handle. The side wings 42, 44, then wrap around and connect on the bottom of the pipe or valve. The side wings may contain connectors 46, 48 by which the module 40 can be electrically connected to a first 50 and/or second linear module 52. The first linear module 50 may have been trimmed to correct length to reach the valve and a connector 54 installed on the trimmed end to allow easy connection with the valve module 40, as the second linear module 52 may have been trimmed as well. It is also possible that the valve module 40 can be connected directly to a power supply, independently of the other modules.

An advantage of the present invention is that since the heating element is woven back and forth within a relatively large surface area, a large amount of wattage/foot can be generated compared to more traditional heating cable such as Mineral Insulated (MI) cable. Prior art modular heaters such as in U.S. Pat. No. 4,638,150 to Whitney use rigid heating modules which are far too inflexible to be of use in wrapping pipes effectively. Although there may be some flexibility in the wires which connect these rigid modules of Whitney together, the overall structure is not very flexible. In contrast, the present invention is flexible in both the longitudinal and transverse planes. The modules are well designed for field installations, and repairs are simple, since a damaged module can be disconnected and a new one easily installed.

Of course, there are many applications in which the modular heaters 10 may be used as a flat sheet, and they are obviously not limited to applications where they are wrapped around a pipe.

The modular design disclosed above can also be utilized for lower temperature applications such as preventing water pipes from freezing in the winter. In such cases, much lower voltages of 24 volts or less can be used and a variety of heater wire materials can be used, including polymers having a positive temperature coefficient (PTC). Such PTC materials can act as self-limiting heaters since and PTC materials increase their resistivity with temperature. Thus as the temperature increases, the resistance of the heater increases and current flow is decreased until an equilibrium temperature is reached. Low voltage heaters are especially useful in situations in which hazardous or volatile materials are present, such as "zone 0" and "zone 1" areas.

In addition to PTC materials, which have a positive temperature coefficient, there are materials which have a negative temperature coefficient (NTC) and no response at all, known as zero temperature coefficient (ZTC) materials. PTC, NTC, and ZTC materials are commonly based on semi-crystalline polymers like Polyethylene (PE), Polypropylene (PP), Polyvinyl chloride (PVC), fluoropolymers and fluoroelastimers, rubbers, silicones, and other recoverable elastic polymeric materials suitable to incorporate fillers to render them conductive and also processable into forms such as cables, strips, etc. Manufacturing is done by convention methods of extrusion, molding, laminating and other coating methods known in the polymer processing industry.

Polymer PTC materials are especially useful for such applications as wrapping pipes, because they are much more flexible than in previously available rigid modules. Additionally, PTC material which has been formed into coaxial cable, such as will be described below, can be used as a heating element by weaving it back and forth within an area, in the same manner as the high temperature heater wire 16, described above.

Thus, a second preferred embodiment is a self-regulating modular heater which uses polymer PTC material to act as heating elements which are connected in parallel across bus wires. As before, the modular sections are connectable to create cables of any length and each module can be trimmed to length at any boundary of a heating zone. The PTC heater is serpentined on a substrate which is preferably a flexible insulator, such as glass wool, foam, etc. or especially material commercially known as Astrofoil or Reflectex, which is an insulator with a reflective surface on both the inside and outside of the insulation package. Astrofoil is desirable because it reduces radiative heat loss, and it can provide a good thermal and moisture barrier. The heater is held in place on the substrate by tape or ties. This is then laminated with aluminum, aluminum/mylar or any other conductive/insulative composite layer or layers.

These modular heaters can be used for heating pipes, etc. as discussed above, and can also be used to warm mattresses, trauma blankets and used in medical applications. The devices can be designed for low power uses, 12 volts, etc., where the power can be supplied by batteries. Thus they are very useful for emergency devices or camping applications, where line voltage is not available.

Figure 4:
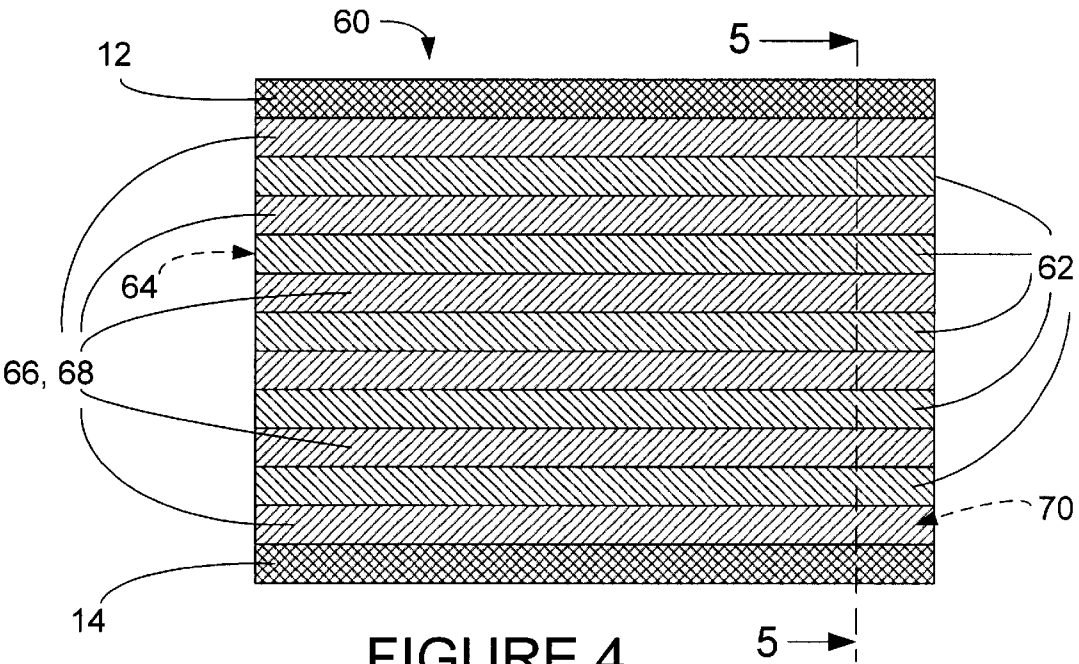
FIG. 4 shows one section of an etched foil heating strip of the present invention with any top insulating cover removed.
Figure 5:
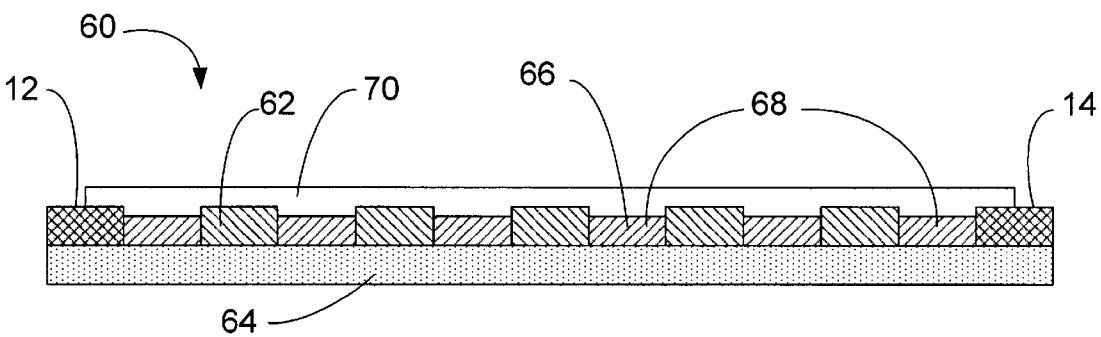
FIG. 5 illustrates a cross-sectional view of the etched foil heater of FIG. 4 as taken through line 5—5.

A third preferred embodiment of the present invention is a heater device using PTC which has been laminated onto an etched foil layer to form a heater strip 60. Using this device, power levels of ¼ to 2 watts/inch$^2$ or higher can be generated, producing temperatures in the range of 110° F.–180° F. or higher. A typical section of heater strip using etched foil is shown in FIGS. 4 & 5. There is preferably a top insulating layer, which has been removed for ease of viewing in these two figures. In some respects the heater strip is similar in structure to the modular heaters described above, and indeed it is possible to configure the PTC strips into discrete zones, as before. However the embodiment pictured has the PTC elements in continuous stripes, which extend the length of the heater. These can be cut to length as before, but without the limitation that the zone boundaries are the preferred areas for cutting. There are again two supply bus wires 12, 14 with a number of PTC heating elements 62 connected in series between the bus wires 12, 14. The PTC elements 62 rest on a substrate 64 which is covered by an foil layer 66 which has been etched so that conductive pathways 68 are left to connect the PTC elements 62 in series. An optional feature which has been incorporated into this preferred embodiment is a coating of negative temperature coefficient (NTC) material 70. NTC material maintains high resistance until a certain temperature range is reached, at which point, the resistance rapidly decreases. This NTC coating can thus be used as a safety shunt to divert current if hot spots occur in the heating module elements. It is also possible to use material having no temperature coefficient response, but will act as a shunt merely by presenting a parallel current path of lesser resistance if the temperature and the resistance of the PTC layer is too high. FIG. 5 shows a cross-section of the heater module taken through line 5—5 of FIG. 4.

As mentioned above, the heater strips 60 can be configured into modules, and it is again possible to connect modules together, and to cut the modules 60 at any length. The substrate 64 can be insulated PTC tape as well as other, conventional materials. An advantage of the present invention is that it can be used at high voltages such as 240 volts and 480 volts, since the elements connected in the series string divide the voltage, so that, for example, each of 5 elements shown would drop 48 volts or 96 volts, respectively. It is of course possible to have single units prepared on smaller etched foil sections which are independent units. It will be obvious to one skilled in the art that other electronic components can be incorporated into the etched foil design, and all of these are contemplated by the present invention.

Figure 6:
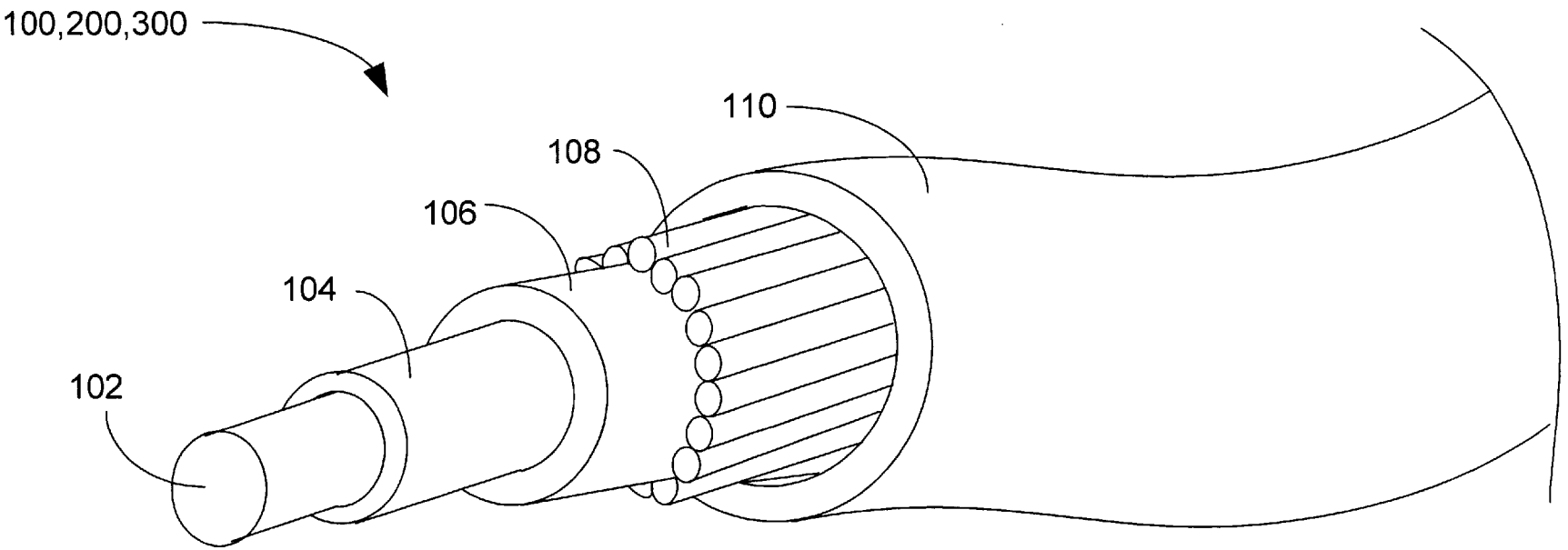
FIG. 6 shows a coaxial heater cable of the present invention in a perspective view.

FIG. 6 illustrates a fourth preferred embodiment of the present invention, which is a coaxial heater cable, which will be designated by the reference character 100. This embodiment is a self-regulating heating cable which has one, or preferably two layers of polymeric PTC material concentrically layered between a central electrode wire and an outer electrode wire which is preferably in the form of a stranded ground sheath. This configuration resembles a standard coaxial cable, but the PTC layers actually act as an extended resistor circuit in parallel with the two electrodes. It has advantages in providing very rapid response time to achieve an equilibrium state, and can operate at very low voltages. It is also very easy to detect shorts in the wires by linear resistance analysis. It too can be easily cut to length to suit the application, or as in the modular embodiments, lengths can be joined together to make a composite length, much in the way that extension cords can be connected together. An additional advantage of the present invention is that by having a circular cross-section, the overall bulk of the cable connector system is reduced compared to cables which have an elliptical or rectangular cross-section.

The central electrode 102 can be a unitary wire, or preferably a 16 AWG nickel-copper stranded bus wire, although any gage is possible, which is surrounded by a first layer 104 of semi-conductive positive temperature coefficient (PTC) material, possibly formed by extrusion. This is surrounded by a second layer 106 of high temperature polymer, preferably PTC or negative temperature coefficient (NTC) material, or even conventional zero-temperature coefficient (ZTC) material, which itself is surrounded by the second electrode 108, which is preferably 16 AWG equivalent nickel-copper braid. The whole is surrounded by a fluoropolymer or any other appropriate outer insulation 110. Once again, no attempt has been made to portray the relative thicknesses of the layers in proper size relation to each other. The layers 104, 106 may also have an optional conductive layer (not shown) which assures good electrical contact between the first layer 104 and the second layer 106, and between the second layer 106 and the outer electrode 108.

For some applications, an additional ground braid and final insulation layer may be added so that the cable is triaxial in nature. In such a triaxial configuration, it is possible to have the first layer 104 of PTC material between the inner 102 and outer 108 electrodes as before, with the second layer 106 now positioned between the outer electrode 108 and the new ground braid (not shown), with the outer insulation 110 surrounding all. It is also possible that the ground wire is not in the form of a braided wire, but instead is a wrapped wire, of a form which is well known in the art, but which is used in this novel way in the present invention.

This coaxial heater cable 100 is also very well suited for low voltage operations, such as 12 or 24 volts, such as are found in camping equipment, etc. The power to these systems can be provided by batteries or similar power supplies.

Some prior art cable heaters have been configured with two electrode wires side by side with PTC material between them so that the entire cross-sectional is lozenge-shaped or oval. Such a configuration limits flexibility in the direction of the larger cross-sectional dimension. A circular configuration allows for good flexibility in all directions. The circular cross-section makes stripping wires easy by conventional wire strippers which may not be useable with oval cross-sectioned prior art heater wires. A circular construction also provides more uniform heat production and distribution. Among prior art heater cables which have been configured with a circular cross-section, most have had the outer electrode helically wrapped about the PTC layer. This can lead to inconsistencies which produce localized variations in heating along the length, and instabilities in performance.

Figure 7:
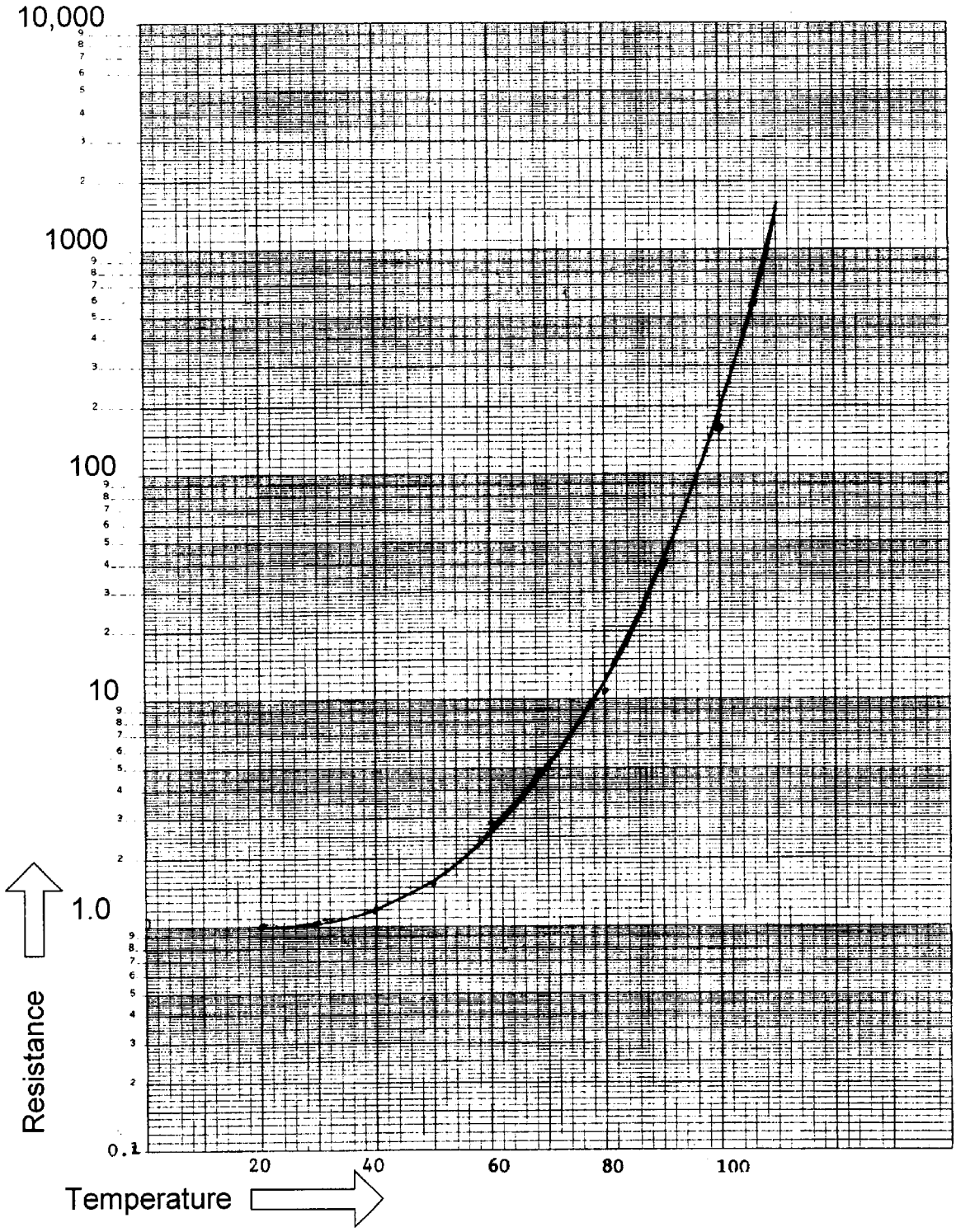
FIG. 7 illustrates a graph of Resistance vs. Temperature for PTC heaters.

An additional advantage has been found in the use of two layers of PTC materials, which, if chosen correctly, can allow generally the same power output at different supply voltages. Typically, to generate adequate power levels in heater wires where a single layer of small thickness is used, the resistivity of the layer has to be very high, in the range of several meg-ohms per centimeter. However, the present invention 100 uses 2 thin layers having resistivity of around 150,000 ohms per centimeter. The two layers 104, 106 can be modeled as two resistors in series forming a voltage divider between the inner 102 and outer 108 electrodes. The power generated in each resistor (layer) is equal to the square of the voltage divided by the resistance, $P=V^2/R$. By having a very thin first layer, the current flowing through a given volume (current density) of PTC material is high, compared to the current density in a thicker layer, or an outer layer of equal thickness. This current density causes a rise in temperature that causes the resistance of the material to rapidly increase (see the chart of Resistance vs. Temperature, FIG. 7). The material composition is chosen so that for the expected voltage range, the material will behave in the right-hand region of the curve in which the resistance is increasing exponentially, in fact much faster than the voltage squared factor in the power equation. Thus as the resistance of the first resistor (layer) shoots up exponentially, the proportional voltage across it increases, but not as fast as the resistance. The power thus increases very little. The second layer is also heated, but has less current density, and thus increases resistance to a lesser degree. The first layer of course also heats the second, and eventually (actually, in fractions of a second) comes to an equilibrium.

The same sort of equilibrium process takes place if single layer is used, except that if a unitary layer of PTC material of a thickness equivalent to the combined thickness of both layers in the present invention is used, the current density will be much less. The material will tend to act more in the left-hand region of the curve of FIG. 7, where increase in resistance may not outpace increase in voltage, thus the power consumed will be higher. This change in power consumption may be undesirable when dealing with different power supplies.

A practical application of this is in the use of heater cables with power supplies in the range of 12 to 240 volts. Currently, heater cables using a single layer of material must be designed differently to work with 120 volt line voltages, rather than with 240 volt supplies, as each must be rated for different ranges of power usage.

In contrast, the present invention 100 may be used with 12 volt, 120 volt and 240 volt power supplies with proper selection of PTC layer resistance, since as the resistance of the first layer 104 operates in a higher range in the exponential curve, the power used lies in the same power rating range. Thus one product can take the place of two.

As referred to before, the second layer 106 can be made of NTC material or material which has no temperature coefficient (ZTC), in which case the power consumption characteristics of the cable are further variable. One advantage of such a combination is that when the resistance of the NTC or ZTC layer is high with respect to the PTC layer the overall resistance of the circuit is high which limits the initial current first rushing into the circuit. Therefore circuit breakers used with such a circuit can be smaller in rating.

The cables may be fabricated by a variety of processes. The layers can be extruded, or could be applied by dipping the wires or spraying coatings to form the layers.

These coaxial heater cables have many uses. They have industrial uses to protect pipes, both over and underground, water lines, and vessels from freezing, as well as warming flooring, drains, overflow pans, and maintaining temperatures for hot water and steam pipes. They can additionally be used for de-icing roofs and gutters. They may also be used to maintain pipe temperatures where the temperature of materials need to be maintained in a certain range so that their viscosity and flow characteristics are maintained.

A further embodiment 200 has been produced which uses very low voltages in the range of 0.1 to 12 volts, of both AC and DC, so that these heaters can be run on voltages produced by batteries, as well as by low voltage AC transformers. For such small voltages, the thicknesses of the first and second layers 104, 106 (see FIG. 6) are reduced. Minimum thickness dimensions of the first and second layers for devices which operate in the 12–240 volt range are generally 0.01 in with resistivity greater than 1 ohm-cms. In contrast, for the voltage range of 0.1 volt to 12 volts, the minimum thickness is preferred to be as little as 0.001 inch, with resistivity greater than 0.05 ohm-cms. It may also be desired that the dimensions of the other layers be reduced for portability or flexibility considerations, so that the inner electrode 102 may have sizes running from 36 to 10 gauge.

For low voltage operation, it is presently preferred that the second layer 106 be of ZTC material of low resistivity material with resistivity lower than 0.05 ohm-cms. By having the second layer 106 of low resistivity, there is more uniformity of temperature with fewer hot spots. As the cable is flexed, there will usually be areas where the second electrode 108 has buckled away from contact with the second layer 106. Current will naturally flow to the points where contact is still maintained. If a high resistivity material is used, there will be more resistance to current flow in the paths leading to these contact points, whereas in low resistivity material the resistance is less, current flow is more diffused and there are fewer hot spots produced.

An embodiment 300 has also been produced for high voltage operations above 240 volts, such as 277 volts, 360 volts and 460 volts, etc. For these applications, it is desired that the minimum thickness of the first and second layers 104, 106 be increased to 0.25 inches. The inner electrode 102 preferably has sizes running from 36 to 8 gage. For high voltage applications, it is also preferred that the second layer 106 be of ZTC material of low resistivity material with resistivity less than 1.5 ohm-cms, for the reasons of temperature uniformity discussed above.

For both the low voltage cables of 0.1–12 volts, and the high voltage cables of above 240 volts, the second layer 106 can be PTC, NTC or ZTC material, as described above. Also as described above, either of the first and second layers may act as the ground wire, there may be a third layer and third electrode and the first and second layers are preferably, but not necessarily, concentric with the first electrode. Both low and high voltage cables are continuously variable in length, and are preferably configured into modules which are attachable and detachable so that the overall length of the heating device may be varied.

A fifth preferred embodiment of the present invention is a resettable fuse utilizing one or more PTC, NTC or ZTC elements. If PTC elements are to be used, the elements are placed in series in the circuit to be protected. Then, as current rises, the temperature rises, causing the resistance to rise to the point where the element acts as an open in the circuit, and power is shut off. After the temperature cools down, the resistance also reduces, and the fuse "resets" to allow operation again. If NTC material is used, the element is placed in parallel with the circuit, so that as the element heats, resistance lowers and current is shunted around the circuit, thus shutting it off.

The presently preferred embodiment of this type of fuse is a single layer of PTC or NTC material deposited on a substrate such as etched foil or insulation with electrical contacts implanted. One great advantage of the resettable fuse is that since it is reusable, it does not need to be replaced after having been triggered. It can thus be built into the circuit as an integral element, and can be physically located in generally inaccessible areas on PC boards, etched foil circuits and even buried cables. Another advantage of the present invention is that because the PTC layers are relatively thin, they heat very rapidly. The response time of the element can thus be very fast, as short as a few thousandths of a second.

In operating electronic equipment or circuits, voltage spikes are common. Just as current spikes are introduced through the normal operation of machinery and materials, voltage spikes are also introduced and need to be controlled. Certain devices or circuits may need protection from both current and voltage spikes. A PTC device when put in series with a device, acts as a thermally activated fuse when high current passes through it. Although the response time is fairly quick, it may be too slow to react to transient voltage spikes. New materials which are sensitive to changes in voltage, voltage sensitive materials (VSM) can act very quickly in comparison, in the nano-second range, and thus can provide voltage spike protection, where a PTC device alone may not. Thus it may be desirable to include both kinds of protection for a device or circuit using both PTC and VSM elements. VSM materials are generally produced by introducing metal oxide material, such as aluminum oxide or zinc oxide into polymer materials such as are used in PTC materials.

Figure 8:
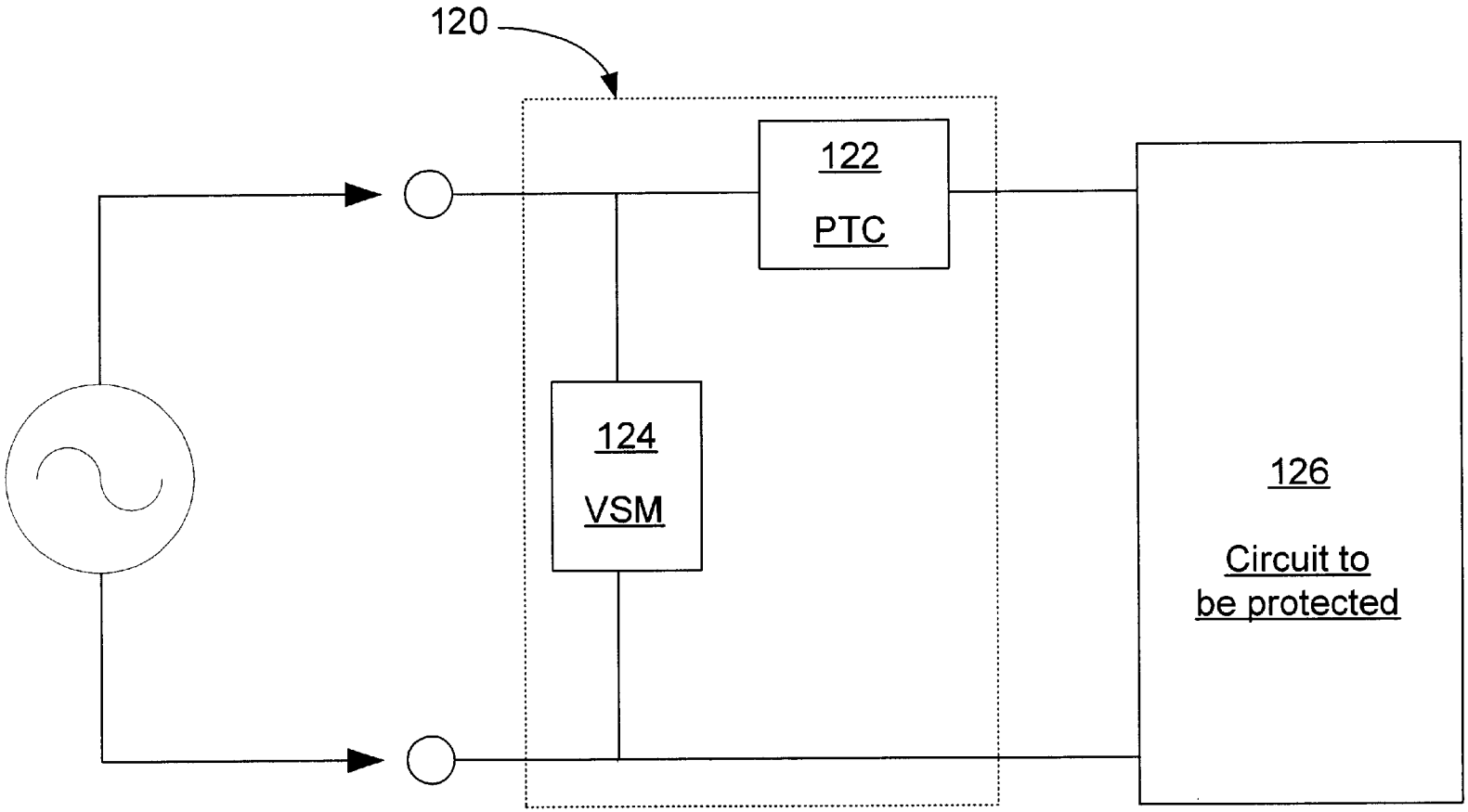
FIG. 8 shows a circuit schematic of a circuit using a resettable fuse with voltage spike protection.

Thus, referring to FIG. 8, another protective application of the resettable fuse element 120 can be where a VSM element 124 is placed in parallel with a PTC element 122, which is in series with the circuit to be protected 126. The PTC element 122 will protect the circuit 126 from current which is too high. The resistance of the VSM 124 breaks down when a voltage limit is reached, and then acts as a shunt, cutting off current to both the PTC element 122 and the circuit to be protected 126. Being in parallel to the circuit, it will not interfere with normal operation of the circuit, and normally has such high resistance that it acts as an open circuit. A similar configuration was discussed above concerning the use of NTC material as a shunt, but again, since the response of an NTC device is based on thermal response, the response time will be very much slower than that achieved by the VSM material.

VSM can also be made from polymers made conductive by the addition of metals such as aluminum, zinc, etc. VSM elements can be made very thin, a few thousandths of an inch thick, and can be designed for any voltage and resistance range. VSM devices also act as "resettable switches". As with PTC materials, several methods of fabrication are possible. If made with a polymer base, the material can be extruded, extrusion coated, or solvent coated, or made into a paste for coating on a chip. It is also possible to include both PTC and VSM material on the same chip, in layers, or through deposits controlled by masks. Both types of elements are especially useful in such configurations because they are easily included on the same substrate as the circuit to be protected, and can be integrally formed during PC board fabrication, since they will never have to be removed or replaced.

In addition to the above mentioned examples, various other modifications and alterations of the inventive devices disclosed above may be made without departing from the invention.

INDUSTRIAL APPLICABILITY

The modular heaters of the present invention are well suited for use in a variety of industrial, manufacturing and domestic applications.

There are many applications in which it is desirable to wrap irregular objects, such as pipeline valves with heating devices. Many of these applications also require much flexibility in the amount and shape of the heater material used. For this reason, it is highly desirable that self-regulating heaters be modular in design, so that specific lengths of heater material may be joined together to make greater lengths, and also desirable that the lengths be capable of being trimmed to shorter lengths, without of course losing power or heating capacity.

There are many applications in which materials must be maintained at high-temperature in the range of 500–600 degrees F. Such applications include maintaining asphalt and sulfur in a liquid state. If these materials can be kept in a molten state, they can be made to flow through pipes, thus easily conveying them to a site of usage. A difficulty encountered when piping these materials, however, is the heat loss experienced when the material is forced to flow through unheated pipes. Heat loss can be great from these pipes, causing the material to solidify and block material flow.

An embodiment of the present invention 200 provides low voltage self-regulating heaters which are very flexible, which can be manufactured in a series of modules 30 which can be connected together to cover nearly any length of pipe, and which can also be trimmed to length and the trimmed end sealed to further accommodate any intermediate length of pipe. For wrapping pipe fittings such as valves, T's and flanges, special modular sections can be designed. A type of the first embodiment of the present invention is a modular valve heater 40 which can be installed on a pipe valve. The valve heater 40 may be designed in a generally "U" shape, which slides on with the slot 41 of the U surrounding the valve handle. The side wings 42, 44, then wrap around and connect on the bottom of the pipe or valve. The modular design disclosed above can also be utilized for lower temperature applications such as preventing water pipes from freezing in the winter. In such cases, much lower voltages of 24 volts or less can be used and a variety of heater wire materials can be used, including polymers having a positive temperature coefficient (PTC). Such PTC materials can act as self-limiting heaters since and PTC materials increase their resistivity with temperature. Thus as the temperature increases, the resistance of the heater increases and current flow is decreased until an equilibrium temperature is reached. Low voltage heaters are especially useful in situations in which hazardous or volatile materials are present, such as "zone 0" and "zone 1" areas.

These modular heaters can be used for heating pipes, etc. as discussed above, and can also be used to warm mattresses, trauma blankets and used in medical applications. The devices can be designed for low power uses, 12 volts, and below., where the power can be supplied by batteries. Thus they are very useful for emergency devices or camping applications, where line voltage is not available.

Polymer PTC materials are especially useful for such applications as wrapping pipes, because they are much more flexible than in previously available rigid modules. Additionally, PTC material which has been formed into coaxial cable, can be used as a heating element by weaving it back and forth within an area.

Another embodiment 300 is a self-regulating modular heater which high voltage above 240 volts, such as 277, 360 and 460 volts, etc. These can be used for high temperature applications such as heating pipes which convey molten sulpher, etc.

These embodiments 200, 300 of the present invention are preferably configured as coaxial heater cables. This embodiment is a self-regulating heating cable which has one, or preferably two layers of polymeric PTC material concentrically layered between a central electrode wire and an outer electrode wire which is preferably in the form of a stranded ground sheath. This configuration resembles a standard coaxial cable, but the PTC layers actually act as an extended resistor circuit in parallel with the two electrodes. It has advantages in providing very rapid response time to achieve an equilibrium state, and can operate at very low voltages. It is also very easy to detect shorts in the wires by linear resistance analysis. It too can be easily cut to length to suit the application.

These coaxial heater cables 200, 300 have many uses. They have industrial uses to protect pipes, both over and underground, water lines, and vessels from freezing, as well as warming flooring, drains, overflow pans, and maintaining temperatures for hot water and steam pipes. They can additionally be used for de-icing roofs and gutters. They may also be used to maintain pipe temperatures where the temperature of materials need to be maintained in a certain range so that their viscosity and flow characteristics are maintained Thus, there are a great variety of applications for the various embodiments of the present invention. For the above, and other, reasons, it is expected that the various modular heaters of the present invention will have widespread industrial applicability. Therefore, it is expected that the commercial utility of the present invention will be extensive and long lasting.

What is claimed is:

1. A self regulating heating device for applied voltages in the range of 0.1 volt to 12 volts, comprising:

a first electrode;

a second electrode;

a first layer of PTC material having a minimum thickness of 0.001 inches interposed between said first electrode and said second electrode; and a second layer of material interposed between said first electrode and said second electrode.

2. A self-regulating heating device as in claim 1, wherein: said second layer is also PTC material.

3. A self-regulating heating device as in claim 1, wherein: said second layer is NTC material.

4. A self-regulating heating device as in claim 1, wherein: said second layer is ZTC material.

5. A self-regulating heating device as in claim 4, wherein: said second layer of material is low resistivity ZTC material having a resistivity lower than 0.05 ohm-cms.

6. A self-regulating heating device as in claim 1, wherein: said first and second layers and said second electrode are concentric with said first electrode.

7. A self-regulating heating device as in claim 1, wherein: said first electrode is a ground wire.

8. A self-regulating heating device as in claim 1, wherein: said second electrode is a ground wire.

9. A self-regulating heating device as in claim 1, wherein: said second electrode is a braided wire.

10. A self-regulating heating device as in claim 1, wherein:

said second electrode is a wrapped wire.

11. A self-regulating heating device as in claim 1, further comprising:

an insulation layer.

12. A self-regulating heating device as in claim 1, further comprising:

a third layer and a third electrode.

13. A self-regulating heating device as in claim 1, which is continuously variable in length.

14. A self-regulating heating device as in claim 1, which is configured into modules, which are attachable and detachable so that the overall length of the heating device may be varied thereby.

15. A self regulating heating device for applied voltages above 240 volts, comprising:

a first electrode;

a second electrode;

a first layer of PTC material having a minimum thickness of 0.025 inches interposed between said first electrode and said second electrode; and a second layer of material interposed between said first electrode and said second electrode.

16. A self-regulating heating device as in claim 15, wherein:

said second layer is also PTC material.

17. A self-regulating heating device as in claim 15, wherein:

said second layer is NTC material.

18. A self-regulating heating device as in claim 15, wherein:

said second layer is ZTC material.

19. A self-regulating heating device as in claim 18, wherein:

said second layer is low resistivity ZTC material having a resistivity lower than 1.5 ohm-cms.

20. A self-regulating heating device as in claim 15, wherein:

said first and second layers and said second electrode are concentric with said first electrode.

21. A self-regulating heating device as in claim 15, wherein:

said first electrode is a ground wire.

22. A self-regulating heating device as in claim 15, wherein:

said second electrode is a ground wire.

23. A self-regulating heating device as in claim 15, wherein:

said second electrode is a braided wire.

24. A self-regulating heating device as in claim 15, wherein:

said second electrode is a wrapped wire.

25. A self-regulating heating device as in claim 15, further comprising:

an insulation layer.

26. A self-regulating heating device as in claim 15, further comprising:

a third layer and a third electrode.

27. A self-regulating heating device as in claim 15, which is continuously variable in length.

28. A self-regulating heating device as in claim 15, which is configured into modules, which are attachable and detachable so that the overall length of the heating device may be varied thereby.

* * * * *